US010662741B2

(12) United States Patent
Saraya et al.

(10) Patent No.: US 10,662,741 B2
(45) **Date of Patent: *May 26, 2020**

(54) METHODS AND SYSTEMS FOR A TOOL WITH A CHAMBER TO REGULATE A VELOCITY OF FLUID BETWEEN AN OUTER DIAMETER OF A PISTON AND AN INSERT

(71) Applicant: COMITT WELL SOLUTIONS US HOLDING INC., Katy, TX (US)

(72) Inventors: Mohamed Ibrahim Saraya, Sugarland, TX (US); Roger Antonsen, Houston, TX (US); Peter Kris CLeven, Houston, TX (US)

(73) Assignee: COMITT WELL SOLUTIONS US HOLDING INC., Katy ( * ) Notice: Subject to any disclaimer, the term of this patent is extended or adjusted under 35 U.S.C. 154(b) by 0 days.

This patent is subject to a terminal disclaimer.

(21) Appl. No.: 16/383,009

(22) Filed: Apr. 12, 2019

(65) Prior Publication Data

US 2019/0257185 A1 Aug. 22, 2019

Related U.S. Application Data

(63) Continuation of application No. PCT/US2017/055770, filed on Oct. 9, 2017, which is a continuation of application No. 15/342,874, filed on Nov. 3, 2016, now Pat. No. 10,180,042.

(51) Int. Cl.

| | |
|---|---|
| ***E21B 34/14*** | (2006.01) |
| ***E21B 34/10*** | (2006.01) |
| ***E21B 33/12*** | (2006.01) |
| ***E21B 43/12*** | (2006.01) |
| ***E21B 43/26*** | (2006.01) |
| ***E21B 43/267*** | (2006.01) |

(52) U.S. Cl.

CPC ..... *E21B 34/14* (2013.01); *E21B 33/1208* (2013.01); *E21B 34/10* (2013.01); *E21B 43/12* (2013.01); *E21B 43/26* (2013.01); *E21B 43/267* (2013.01)

(58) Field of Classification Search

CPC ..... E21B 34/14; E21B 43/12; E21B 43/26; E21B 43/267

See application file for complete search history.

(56) References Cited

U.S. PATENT DOCUMENTS

| | | | | |
|---|---|---|---|---|
| 2,177,534 | A * | 10/1939 | Neveu | G10K 9/18 91/321 |
| 3,411,584 | A * | 11/1968 | Sizer | E21B 34/105 166/72 |
| 9,683,424 | B2 * | 6/2017 | Cleven | E21B 33/124 |
| 9,995,110 | B2 * | 6/2018 | Cleven | E21B 34/063 |
| 10,180,042 | B2 * | 1/2019 | Saraya | E21B 34/14 |
| 2013/0168099 | A1 * | 7/2013 | Themig | E21B 34/103 166/308.1 |

* cited by examiner

*Primary Examiner* — Yong-Suk Ro

(74) *Attorney, Agent, or Firm* — Pierson Intellectual Property LLC; Eugene Pierson

(57) ABSTRACT

The present application describes a velocity chamber to regulate a velocity of fluid between an outer diameter of a piston, and an insert to limit, reduce, etc. erosion against the tool and casing.

20 Claims, 3 Drawing Sheets

METHODS AND SYSTEMS FOR A TOOL WITH A CHAMBER TO REGULATE A VELOCITY OF FLUID BETWEEN AN OUTER DIAMETER OF A PISTON AND AN INSERT

BACKGROUND INFORMATION

Field of the Disclosure

Examples of the present disclosure relate to systems and methods utilizing a velocity chamber to decrease a velocity of fluid exiting a tool to limit, reduce, etc. erosion against the tool and casing.

Background

Hydraulic injection is a method performed by pumping fluid into a formation at a pressure sufficient to create fractures in the formation. When a fracture is open, a propping agent may be added to the fluid. The propping agent, e.g. sand or ceramic beads, remains in the fractures to keep the fractures open when the pumping rate and pressure decreases or ceases.

Conventionally, the propping agent flows through an inner diameter of a tool, and exits the tool through a port at a certain velocity. Because the propping agent exits the tool at a high velocity, the force caused by the propping agent will eventually erode the casing surrounding the tool. Furthermore, the propping agent deflects off the casing, and contacts the outer diameter of the tool. This causes erosion against the outer diameter of the tool.

Accordingly, needs exist for system and methods for a tool with a chamber configured to reduce the velocity of fluid and/or propping agent before exiting the tool, while the chamber is also configured to control a pressure differential within and outside the tool.

SUMMARY

Examples of the present disclosure relate to systems and methods utilizing a chamber (referred to hereinafter as "velocity chamber") to decrease a velocity of fluid flowing between an outer diameter of a piston and an insert. By decreasing the velocity of the flowing fluid, erosion against the tool and the casing may be limited, reduced, etc. Furthermore, the piston may be configured to regulate a pressure differential between an area outside of the tool and an inner diameter of tool, such that other hydraulically operated modules, i.e: packers may be set.

Embodiments may include a tool and a piston, wherein a chamber may be formed between an outer diameter of the piston and an inner diameter of the tool.

The tool may be configured to be positioned within a casing in a geological formation. The tool may include a first inner diameter, an insert, and ports. A second inner diameter positioned through the piston.

The piston may be a hydraulically operated piston that is positioned within an inner diameter of the tool. The inner diameter of the piston is smaller than an inner diameter of the tool. The piston may be configured to regulate pressure between the annulus formed between the outer diameter of the tool and the casing ID, and the inner diameter of the tool.

In embodiments, a chamber may be formed between an outer diameter of the piston and an inner diameter of the tool. The chamber may be configured to reduce the velocity of fluid flowing through the chamber and out of the tool via the ports. The chamber may have an inlet zone, expansion zone, and outlet zone. A distance, for the inlet zone and the outlet zone, between the outer diameter of the piston and the insert being positioned on the inner diameter of the tool may be less than that in the expansion zone. Utilizing basic volumetric flow rate equations, the volumetric flow rate through the different zones may be based on the velocity of the fluid and the cross-sectional vector area of the zones. By increasing the cross-sectional vector area within the expansion zone, which is between the inlet zone and the outlet zone, the flow speed of the fluid through the chamber may be reduced.

In embodiments, the piston may be configured to move from a sealed position to an open position. In the sealed position, a sealing surface of the piston may be positioned adjacent to, or substantially adjacent to, the insert to form a seal or partial seal. Utilizing the seal in the sealed position, a pressure differential between the chamber and the inner diameter of the tool may be maintained.

Responsive to flowing fluid through the inner diameter of the tool and piston, a pressure differential may be created on a first end of the piston due to a change in cross sectional area between the inner diameter of the tool and the inner diameter of the piston. This pressure differential may allow the piston to move in a direction corresponding to the flow of fluid through the tool. When the piston moves, the sealing surface may move away from the insert, and allow fluid to flow into the chamber.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
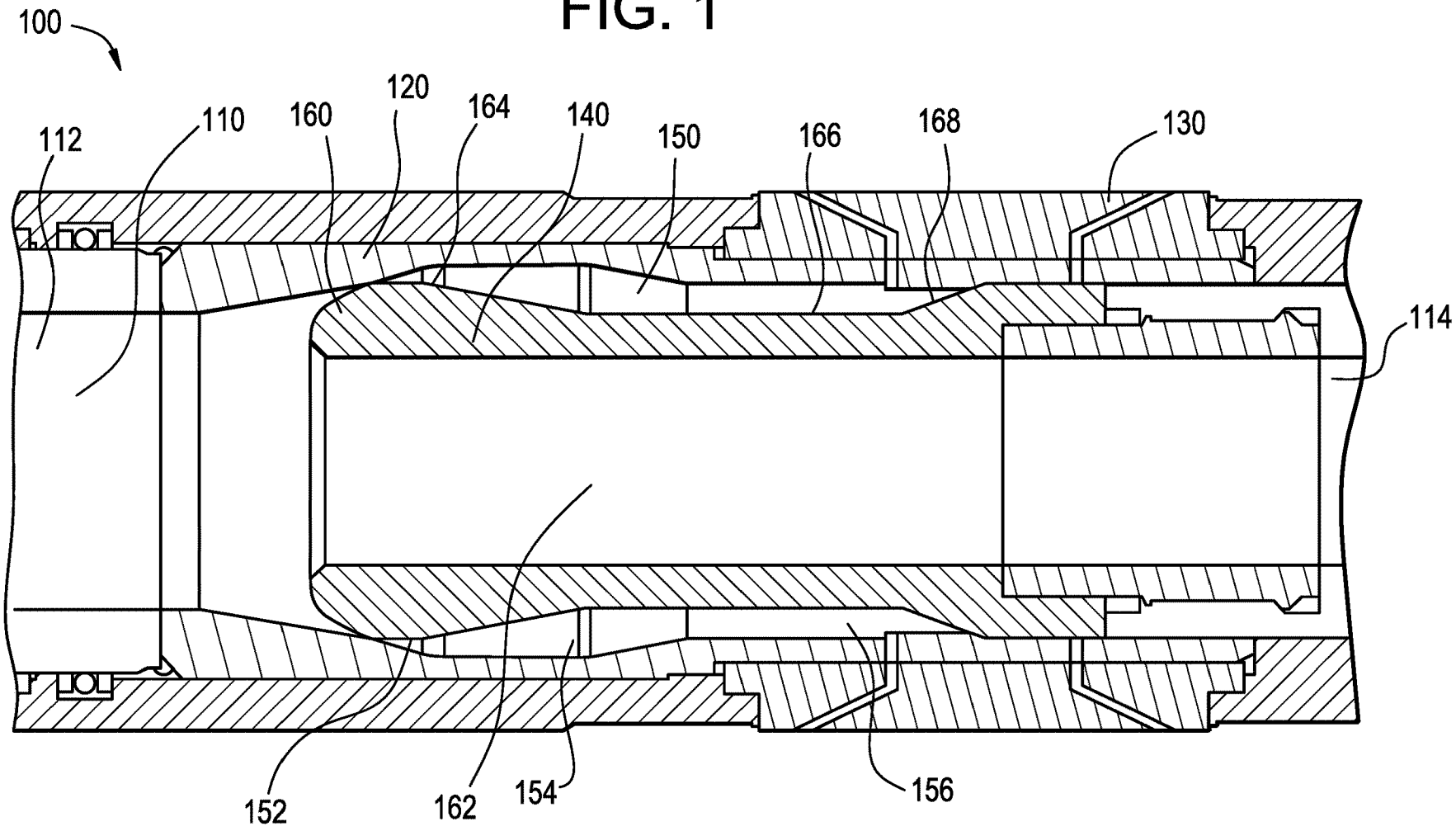
FIG. 1 depicts a tool in a sealed position, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art, that the specific detail need not be employed to practice the present embodiments. In other instances, well-known materials or methods have not been described in detail in order to avoid obscuring the present embodiments.

FIG. 1 depicts a tool 100 in a sealed position, according to an embodiment. Tool 100 may be configured to control a pressure differential between an annulus and an inner diameter 110 of the tool 100 when piston 140 forms a seal, while also reducing the velocity of fluid exiting the tool 100 in an open position.

Tool 100 may include an inner diameter 110, insert 120, ports 130, piston 140, and chamber 150.

Inner diameter 110 of tool 100 may extend across a hollow chamber within tool 100. Fluid may be configured to flow through inner diameter 110 of tool 100 from a proximal end 112 of tool 100 to a distal end 114 of tool 100, and potentially vice versa. A length of inner diameter 110 of tool 100 may change based on a geometric layout of inner diameter 110 of tool 100. Because the length of inner diameter 110 of tool 100 may change between proximal end 112 and distal end 114, a cross-sectional vector area of inner diameter 110 may correspondingly change.

Insert 120 may be positioned adjacent to inner diameter 110 of tool 100. Insert 120 may be a removable insert or may be permanently coupled to tool 100 to form a unified part. Insert 120 may have geometric properties, such as grooves or protrusions that change a length across inner diameter 110 at various locations. In embodiments, insert 120 may be formed of a material that is the same material or different material than tool 100. For example, insert 120 may be comprised of an erosion resistant material, such as carbide.

Ports 130 may be hollow passageways extending from an outer diameter 116 of tool 100 to inner diameter 110. Ports 130 may allow fluid to exit inner diameter 110 of tool 100 into a geological formation. Ports 130 may have a first end that is positioned within chamber 150 and a second end that is positioned within an annulus between tool 100 and a casing. In embodiments, ports 130 may have an angled exit portion, which may allow for directional control of the fluid flowing out of tool 100. This may limit or reduce erosion on tool 100 and or a casing encompassing tool. The angled exit portion of ports 130 may be positioned towards proximal end 112 and/or distal end 114.

Piston 140 may be a hydraulically operated piston positioned within inner diameter 110 of tool 100. In a sealed position, piston 140 may be configured to control a pressure differential between the annulus and inner diameter 110 of tool 100 in the sealed position. In an open position, piston 140 may be configured to reduce the velocity of fluid flowing through chamber 150. In the sealed position, piston 140 may not allow communication between the annulus and inner diameter 110. In the open position, piston 140 may allow fluid to flow from inner diameter 110 into chamber 150. Piston 140 may be configured to move from a sealed position to an open position based on fluid flowing through inner diameter 110 and a first force applied to piston 140. The first force applied to piston 140 may be from a linear adjustable member, such as a spring, in a direction from distal end 114 of tool 100 towards proximal end 112 of tool 100. The fluid flowing through tool 100 may cause a pressure differential on piston area 160 based on inner diameter 110 and piston inner diameter 162. Piston 140 may include a piston area 160, piston inner diameter 162, first tapered sidewall 164, planar sidewall 166, and second tapered sidewall 168.

Piston area 160 may be positioned on a first end of piston 140. Piston area 160 may include a first side that is configured to be adjacent to insert 120 when piston 140 is in a sealed position. In the sealed position, the first side of piston area 160 may form a complete seal or a partial seal against insert 120. Thus, when the seal is formed, inner diameter 110 may not be in communication with the annulus positioned outside of tool 100. However, in the open position, the first side of piston area 160 may not be positioned adjacent to insert 120.

A second side of piston area 160 may be positioned adjacent to piston inner diameter 162. Piston inner diameter 162 may be a length within a hollow passageway of piston 140. A length of piston inner diameter 162 may be less than a length of inner diameter 110 due to piston area 160 extending from insert 120 towards a longitudinal axis of tool 100. Responsive to fluid flowing through inner diameter 110 of tool 100, a first pressure zone may be formed within inner diameter 110 before piston area 160 and a second pressure zone may be formed within piston inner diameter 162. The first pressure zone may have a higher pressure than the second pressure zone due to the bigger cross section across piston inner diameter 162 from inner diameter 110. This increase in pressure within the first pressure zone may cause piston 140 to move towards distal end 114 of tool 100. In other words, once the pressure differential between the pressure zones is greater than the first force applied against piston 140 by the linear adjustable member, piston 140 may move towards distal end 114 of tool 100. However, if the pressure differential is less than the first force, piston 140 may remain or move into the sealed position.

First tapered sidewall 164 may be a sidewall of piston 140 positioned proximal to piston area 160. First tapered sidewall 164 may be angled towards a longitudinal axis of tool 100 to increase a volume within chamber 150. The tapering of first tapered sidewall 164 may be utilized to gradually decrease the velocity of fluid flowing through chamber 150, while also limiting the erosion of elements within tool 100.

Planar sidewall 166 may be a planar sidewall extending in a direction parallel to the longitudinal axis of tool 100, wherein planar sidewall 166 extends from first tapered sidewall 164 to second tapered sidewall 168.

Second tapered sidewall 168 may be a sidewall of piston 140 positioned away from piston area 160. Second tapered sidewall 168 may extend from planar sidewall 166 to a position adjacent to insert 120 and ports 130. Furthermore, second tapered sidewall 168 may be angled away from the longitudinal axis of tool 100 to decrease the cross sectional vector area of chamber 150. This may allow fluid flowing through chamber 150 to change direction toward exit portion of ports 130.

Chamber 150 may be a cavity, compartment, etc. positioned between piston 140 and insert 120. Chamber 150 may be configured to reduce the velocity of fluid flowing through chamber 150 towards ports 130. Chamber 150 may include an inlet zone 152, expansion zone 154, and outlet zone 156.

In the inlet zone 152 and outlet zone 156, a distance between the outer diameter of piston 140 and insert 120 may be less than that in expansion zone 154. Utilizing basic volumetric flow rate equations, the volumetric flow rate through the different zones may be based on the velocity of the fluid and the cross-sectional vector area of the zones. By increasing the cross-sectional vector area within expansion zone 154, the flow velocity of the fluid out of chamber 150 may be reduced.

Figure 2:
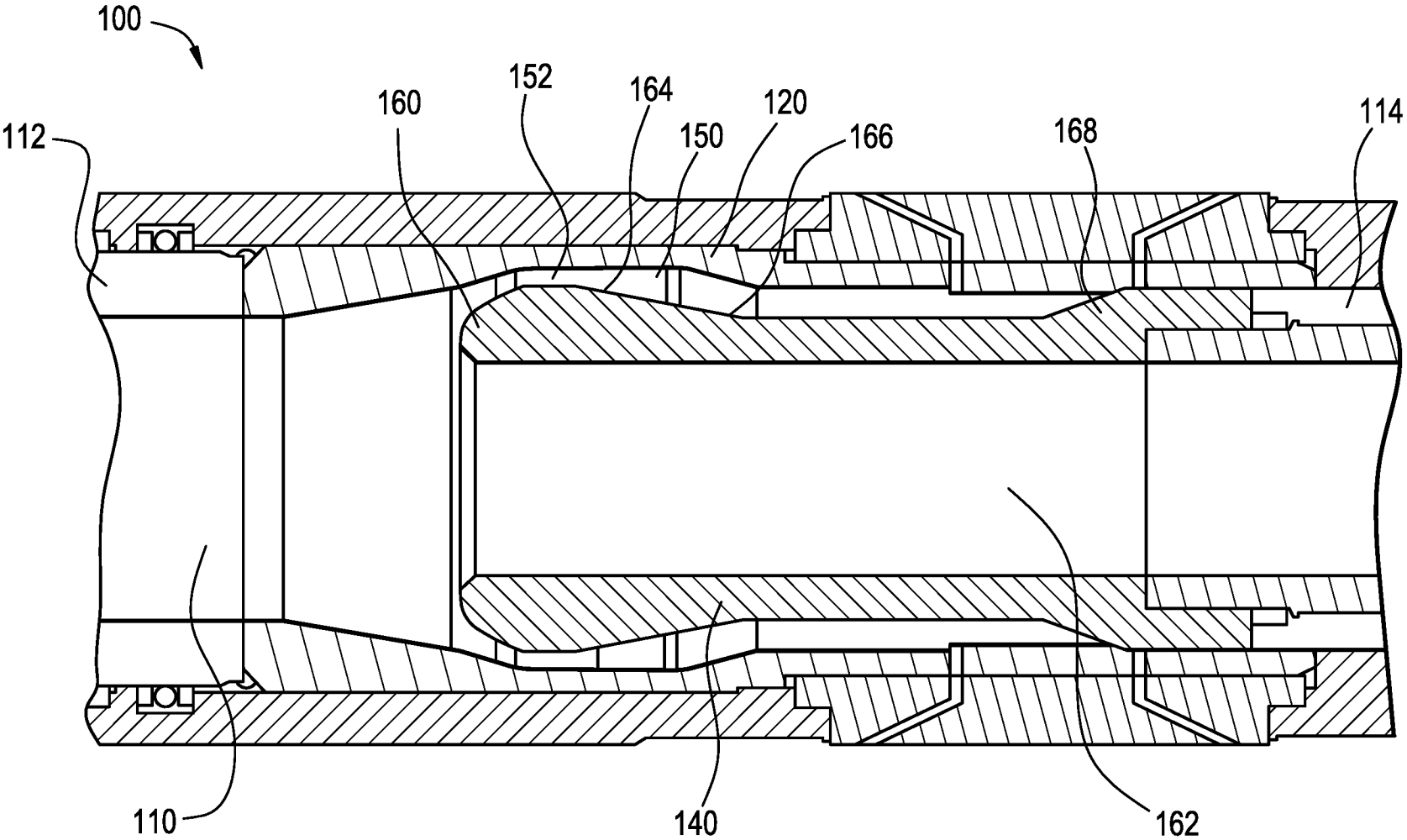
FIG. 2 depicts a tool in an open position, according to an embodiment.

FIG. 2 depicts a tool 100 in an open position, according to an embodiment. As depicted in FIG. 2, piston 140 may move towards a distal end 114 of tool 100, such that piston area 160 is not positioned adjacent to insert 120. However, a second end of piston 140 may be positioned adjacent to inner diameter 110 of tool 100. This may substantially form a seal on the second end of chamber 150.

Piston 140 may move towards distal end 114 responsive to flowing fluid through inner diameter 110. Responsive to flowing fluid through inner diameter 110, a pressure differential may be created on piston area 160 due to the differences in diameters between inner diameter 110 and piston inner diameter 162. This pressure differential may cause piston 140 to move in a direction corresponding to the flow of fluid through tool 100.

When piston 140 moves towards distal end 114, a channel, passageway, opening, etc. may be formed between piston area 160 and insert 120, wherein fluid may flow through the channel into chamber 150. When the fluid flows through the channel and into inlet zone 152, the fluid may be flowing at a first speed based in part on the distance between first tapered sidewall 164 and insert 120. While the fluid continues to flow through chamber 150, the velocity of the fluid may decrease to a second speed based in part on the distance between planar sidewall 166 and insert 120, wherein this distance may be greater than the distance between first tapered sidewall 164 and insert 120. In embodiments, the second speed may be less than the first rate.

In embodiments, responsive to decreasing the fluid flow rate through the inner diameter of tool 100, a linear adjustable member, such as a spring, may return piston 140 to the sealed position. Therefore, once a force upon piston area 160 is less than a counter spring force, the linear adjustable member may move piston 140 towards proximal end 112 of tool 100.

Figure 3:
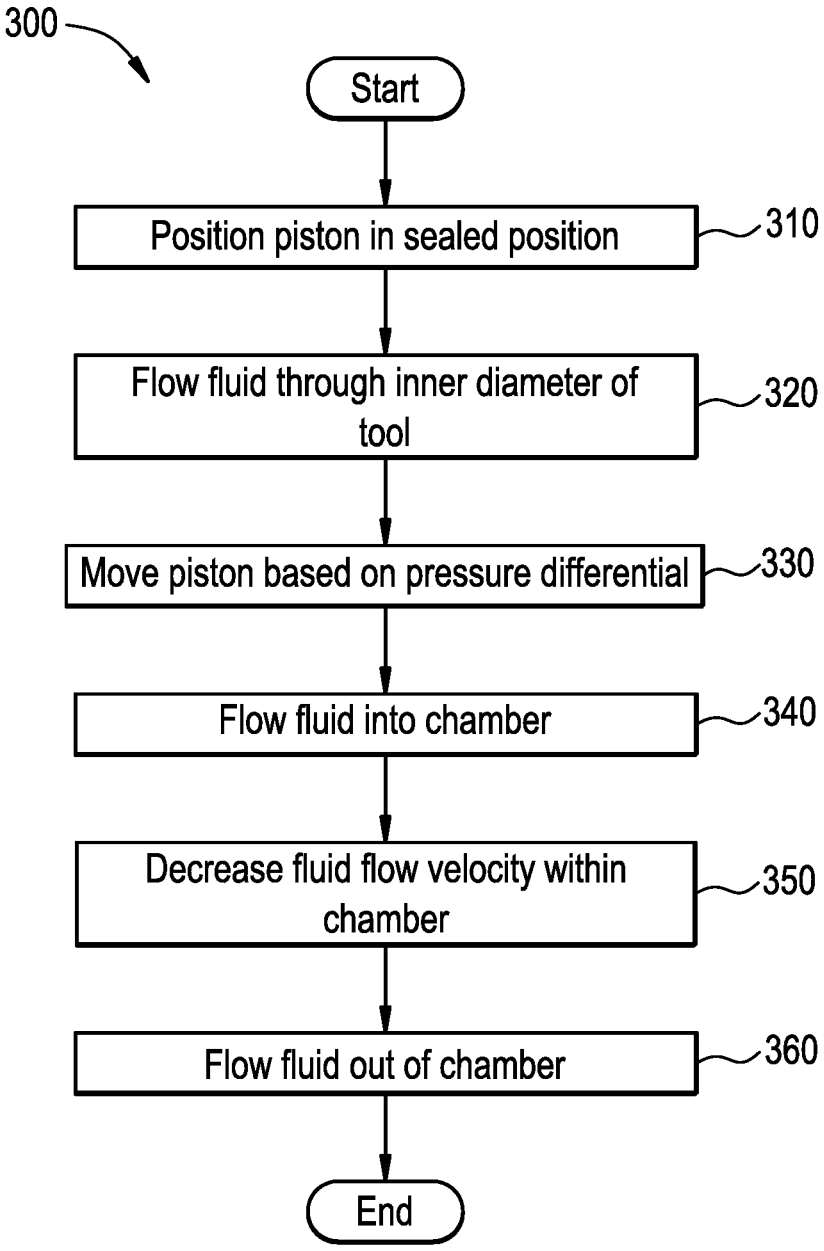
FIG. 3 depicts a method for utilizing a chamber between a piston and an inner diameter of a tool to control the velocity of fluid exiting the tool, according to an embodiment.

FIG. 3 depicts a method 300 for utilizing a velocity chamber to control the flow of fluid, according to an embodiment. The operations of method 300 presented below are intended to be illustrative. In some embodiments, method 300 may be accomplished with one or more additional operations not described, and/or without one or more of the operations discussed.

Additionally, the order in which the operations of method 300 are illustrated in FIG. 3 and described below is not intended to be limiting. Furthermore, the operations of method 300 may be repeated for subsequent valves or zones in a well.

At operation 310, a piston may be set in a sealed position. In the sealed position, a pressure within an inner diameter of a tool may be independent from a pressure within an annulus.

At operation 320, fluid may flow through the inner diameter of the tool.

At operation 330, responsive to fluid flowing through the inner diameter of the tool, a pressure differential may be created on a piston area of the piston due to a change in cross-sectional area between the inner diameter of the tool and the inner diameter of the piston. This may cause the piston to move towards the distal end of the tool.

At operation 340, the fluid may flow through the velocity chamber throw a channel between an outer diameter of the piston and an insert.

At operation 350, a fluid flow velocity of the fluid flowing through the chamber may decrease based on the geometric properties of the chamber.

At operation 360, the fluid may exit the chamber via ports and enter into an annulus at a fluid flow rate that is less than that of when the fluid flowed into the velocity chamber. This decreasing of the fluid flow rate may assist in limiting erosion of the tool and/or casing surrounding the tool.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale. For example, in embodiments, the length of the dart may be longer than the length of the tool.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

The invention claimed is:

1. A tool for fracturing, comprising:

a tool inner diameter extending across a hollow chamber within the tool, a piston with having an outer diameter, the piston being configured to move within the tool inner diameter;

a chamber formed between the tool inner diameter and the outer diameter based on the position of the piston within the tool inner diameter, the chamber having a variable cross-sectional area between the tool inner diameter and the outer diameter of the piston, the chamber being configured to control a velocity and fluid flow rate of fluid flowing between the tool inner diameter and the outer diameter of the piston based on the variable cross-sectional area between the tool inner diameter and the outer diameter of the piston.

2. The tool of claim 1, wherein the piston includes a first tapered sidewall configured to increase the variable cross-sectional area between the outer diameter of the piston and the tool inner diameter, and a second tapered sidewall configured to decrease the variable cross-sectional area between the outer diameter and the tool inner diameter, wherein the outer diameter of the piston is a variable distance.

3. The tool of claim 1, further comprising:

ports extending from the tool inner diameter to a tool outer diameter, wherein the second tapered sidewall is configured to control a direction of fluid flow from the chamber into the ports.

4. The tool of claim 1, wherein in a first mode a first end of the piston is positioned adjacent to the tool inner diameter.

5. The tool of claim 4, wherein in a second mode the first end of the piston is positioned away from the tool inner diameter.

6. The tool of claim 5, wherein in the second mode the chamber includes an inlet zone, and expansion zone, and an outlet zone, the tool inner diameter having a first diameter in the inlet zone, a second inner diameter in the expansion zone, and a third inner diameter in the outlet zone.

7. The tool of claim 6, wherein when fluid flows into the inlet zone the fluid has a first flow rate and when fluid flows through the outlet zone the fluid has a second flow rate, the second flow rate being slower than the first flow rate.

8. The tool of claim 6, wherein a first cross sectional area of the inlet zone is smaller than a second cross sectional area of the expansion zone.

9. The tool of claim 5, wherein the piston is configured to move between the first mode and the second mode based on a fluid flow rate through the tool inner diameter.

10. The tool of claim 1, wherein a second end of the piston is positioned adjacent to the tool inner diameter.

11. A method for using a tool for fracturing, comprising:

moving a piston with having an outer diameter within a tool inner diameter, the tool inner diameter extending across a hollow chamber within the tool;

forming a chamber between the tool inner diameter and the outer diameter based on the position of the piston within the tool inner diameter, the chamber having a variable cross-sectional area between the tool inner diameter and the other diameter of the piston;

controlling, via the chamber, velocity and a fluid flow rate of fluid flowing between the tool inner diameter and the outer diameter based on the variable cross-sectional area between the tool inner diameter and the outer diameter of the piston.

12. The method of claim 11, further comprising:

increasing the variable cross-sectional area between the outer diameter and the tool inner diameter via a first tapered sidewall;

decreasing the variable cross-sectional area between the outer diameter of the piston and the tool inner diameter via a second tapered sidewall, wherein the outer diameter of the piston is a variable distance.

13. The method of claim 11, further comprising:

forming ports that extend from the tool inner diameter to a tool outer diameter, wherein the second tapered sidewall is configured to control a direction of fluid flow from the chamber into the ports.

14. The method of claim 11, further comprising:

positioning, in a first mode, a first end of the piston adjacent to the tool inner diameter.

15. The method of claim 14, further comprising:

positioning, in a second mode, the first end of the piston away from the tool inner diameter.

16. The method of claim 15, wherein in the second mode the chamber includes an inlet zone, and expansion zone, and an outlet zone, the tool inner diameter having a first diameter in the inlet zone, a second inner diameter in the expansion zone, and a third inner diameter in the outlet zone.

17. The method of claim 16, wherein when fluid flows into the inlet zone the fluid has a first flow rate and when fluid flows through the outlet zone the fluid has a second flow rate, the second flow rate being slower than the first flow rate.

18. The method of claim 16, wherein a first cross sectional area of the inlet zone is smaller than a second cross sectional area of the expansion zone.

19. The method of claim 15, further comprising:

moving the piston between the first mode and the second mode based on a fluid flow rate through the tool inner diameter.

20. The method of claim 11, wherein a second end of the piston is positioned adjacent to the tool inner diameter.

* * * * *